US010147272B2

(12) United States Patent
Anderson et al.

(10) Patent No.: US 10,147,272 B2
(45) Date of Patent: Dec. 4, 2018

(54) PROXY LAYER FOR GAME INPUT ABSTRACTION

(71) Applicant: Bally Gaming, Inc., Las Vegas, NV (US)

(72) Inventors: Peter Anderson, Glenview, IL (US); Saravanan Saravanan, Tamil Nadu (IN)

(73) Assignee: Bally Gaming, Inc., Las Vegas, NV (US)

( * ) Notice: Subject to any disclaimer, the term of this patent is extended or adjusted under 35 U.S.C. 154(b) by 902 days.

(21) Appl. No.: 14/314,641

(22) Filed: Jun. 25, 2014

(65) Prior Publication Data

US 2015/0228145 A1 Aug. 13, 2015

Related U.S. Application Data

(60) Provisional application No. 61/844,701, filed on Jul. 10, 2013.

(51) Int. Cl.
*G07F 17/32* (2006.01)

(52) U.S. Cl.
CPC ..... *G07F 17/326* (2013.01); *G07F 17/3223* (2013.01); *G07F 17/3244* (2013.01)

(58) Field of Classification Search
USPC ..... 463/15, 16, 17, 19
See application file for complete search history.

(56) References Cited

U.S. PATENT DOCUMENTS

2004/0224770 A1 11/2004 Wolf et al.
2008/0028208 A1* 1/2008 Bolcer ..... G06F 21/10 713/156
2009/0253503 A1* 10/2009 Krise ..... A63F 3/00 463/31
2009/0275377 A1 11/2009 Anderson et al.
2010/0048292 A1 2/2010 Anderson et al.
2010/0124983 A1 5/2010 Gowin et al.
2011/0165937 A1* 7/2011 Chen ..... G06F 9/541 463/25
2011/0201409 A1* 8/2011 Paykin ..... G07F 17/3241 463/25

* cited by examiner

*Primary Examiner* — Dmitry Suhol
*Assistant Examiner* — Brandon Gray
(74) *Attorney, Agent, or Firm* — Grant A. Dingledine

(57) ABSTRACT

An abstraction layer in a gaming environment intercepts calls to standard random number and user selection functions and returns data based on game operating mode and data availability. When operating as a Class 2 game, random number data may be received from a server while in a Class 3 game, random numbers may be received from a local random number generator. In a history mode or power recovery mode, calls for both random numbers and user selections may be supplied from a file storing data from a previously played or an interrupted game, respectively. Pay table testing may be accommodated by using predetermined random numbers resulting in known reel or other outcome states. The abstraction layer isolates game code from the unique requirements of the different modes of operation required for operating environment or regulatory compliance.

20 Claims, 4 Drawing Sheets

PROXY LAYER FOR GAME INPUT ABSTRACTION

CROSS-REFERENCE TO RELATED APPLICATION

This application claims the benefit of U.S. Provisional Application Ser. No. 61/844,701, filed Jul. 10, 2013. The patent application identified above is incorporated here by reference in its entirety to provide continuity of disclosure.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE DISCLOSURE

The present disclosure relates generally to gaming systems and methods, and more particularly a proxy layer for supporting alternate operating modes in the gaming system without changes to the base game code.

BACKGROUND OF THE DISCLOSURE

Gaming machines, such as slot machines, video poker machines, and the like, have been a cornerstone of the gaming industry for many years. A particular game may be required to have game input data generated in multiple ways or may need to have recent game play activity stored for more than one reason. For example, a so-called Class 3 game may require random numbers from a local random number generator while a Class 2 game may need to pre-fetch random numbers from a remote server. In another example, power recovery, game history for payout validation, pay table testing, etc., may all require different data about a game to be stored and retrieved based on the gaming machine's operating mode.

In traditional gaming machines, the programming to accommodate these various requirements are built into the base game code or may require that base game code targeted for each of these requirements be built, delivered, and maintained separately. This adds complexity to the development of the game and increases the burden of validation and acceptance testing.

SUMMARY OF THE DISCLOSURE

According to an aspect of the disclosure, a gaming system adapted for isolating game code from its operating environment comprises a processor device that executes code, a user interface, coupled to the processor device, for supporting game play and a memory that stores executable code modules and data. The memory may include a game code module that is executed on the processor device to implement at game and a random number proxy module executed on the processor device that receives a request from the game code module for a random number, evaluates a game play setting, and based on the game play setting, chooses a source of random numbers from a plurality of random number sources. Based on the source, the random number proxy module may provide the random number responsive to the request for the random number using the chosen one of the plurality of random number sources. The memory may also include a pick proxy module executed on the processor device that receives a request from the game code module for a user selection, evaluates the game play setting, and based on the game play setting, chooses a source of user selection from a plurality of user selection source. The pick proxy module may return the user selection to the game code module using the chosen one of the plurality of user selection sources.

In another aspect of the disclosure, computer-implemented method is provided in a gaming system having game-logic circuitry including one or more central processing units and one or more memory devices. The method includes receiving, by the game-logic circuitry, a request for a random number from a game executing on the one or more central processing units, the request absent a requested source of the random number. The game-logic circuitry selects a source of random numbers from a plurality of sources of random numbers and provides a response to the request for a random number to the game, the response including a random number from the selected source of random numbers, the response absent an identification of the source of the random number. A visible outcome using the random number is generated on at least one of one or more display devices.

A computer-implemented method may be provided in a gaming system having game-logic circuitry including one or more central processing units and one or more memory devices that includes determining, by the game-logic circuitry, a condition of a current game executing on the gaming system. The game-logic circuitry may intercept a call for data from the current game executing on the gaming system and, based on a condition of game operation, select one of a first source providing real-time data or a second source of data stored in a file on the gaming system associated with a prior game play. The method may further include retrieving, by the game-logic circuitry, data from the selected source, and returning, by the game-logic circuitry, the data responsive to the call for use in continuing the current game that is executing on the gaming system.

Figure 1A:
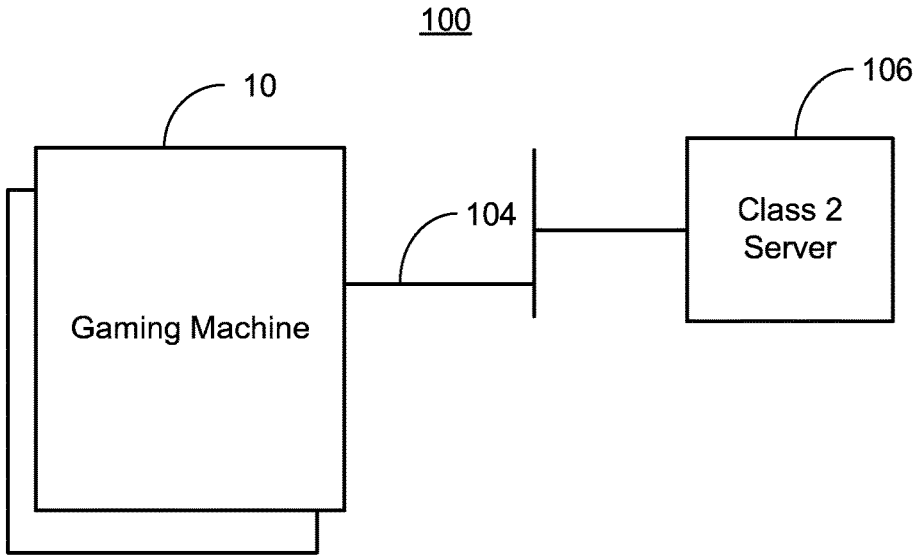
FIG. 1A is a simplified block diagram of a gaming environment.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the appended claims.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts. While the present disclosure may be embodied in many different forms, the embodiments set forth in the present disclosure are to be considered as exemplifications of the principles of the present disclosure and are not intended to be limited to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Gaming machines may be operated in any of a number of configurations. The simplest of these is a standalone configuration where the gaming machine is fully self-contained with respect to its operation. In such a configuration the gaming machine may have a network connection for reporting and configuration, but operation is self-contained. Other exemplary configurations are illustrated in FIG. 1A and FIG. 1B.

FIG. 1A is simplified block diagram of a gaming environment 100. A gaming machine 10 that may be a single machine or one of several gaming machines that may be connected to a Class 2 or other network server 106 via a network 104. In an embodiment, the network 104 may be a local area network. As will be discussed in more detail below, in this configuration, the gaming machine 10 may access the server 106 for data used during game play.

Figure 1B:
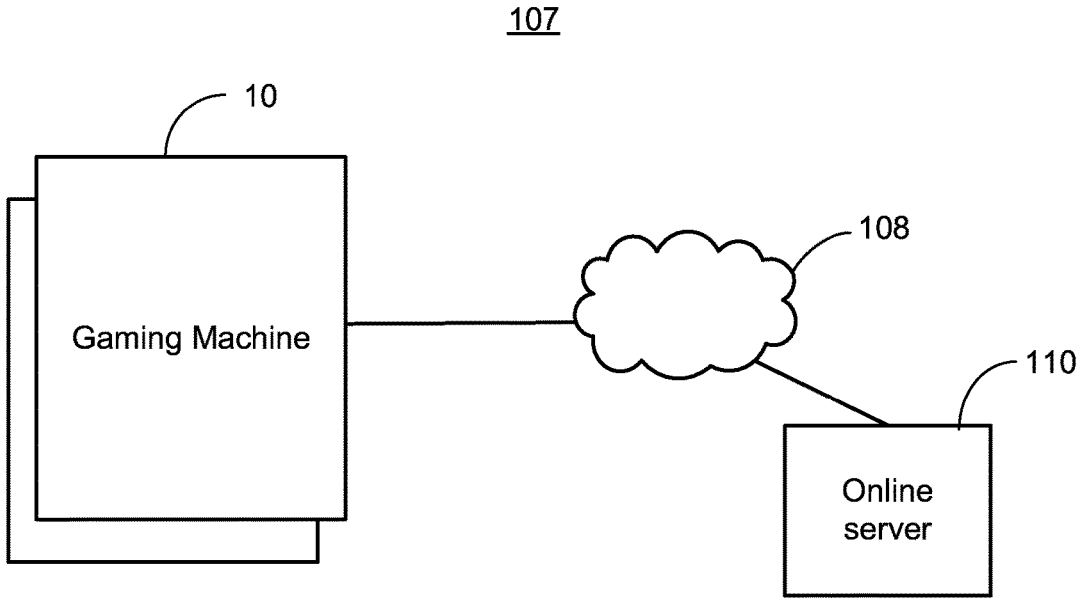
FIG. 1B is a simplified block diagram of another gaming environment.

Similarly, FIG. 1B illustrates another exemplary gaming environment 107. In this embodiment, the gaming machine 10 may also be connected to an online server 110 via a wide area network 108. These embodiments are illustrative only. Other configurations and combinations are possible. Both networks 104 and 108 may be physically embodied in a number of different ways, including without limitation wired, wireless, dial up, cell phone, satellite, etc. using any of many protocols including Ethernet, 802.11, etc.

In various embodiments and game play modes, the gaming machine 10 may operate fully self-contained or may interact with one or more remote resources, such as servers 106 and 110 to support game play. In addition, the gaming machine 10 may be operated in many different modes such as one of several regular play types based on requirements of the local jurisdiction or operator including validation testing, game history review, power recovery, etc. Some of the different modes are discussed in more detail below. As mentioned above, prior art implementations of these different modes may require custom code in each game for each operating mode or even separate code sets that must each be loaded and maintained for each gaming machine 10. This can lead to inefficient game development, longer lead times, more complex validation, and higher maintenance costs.

Figure 2:
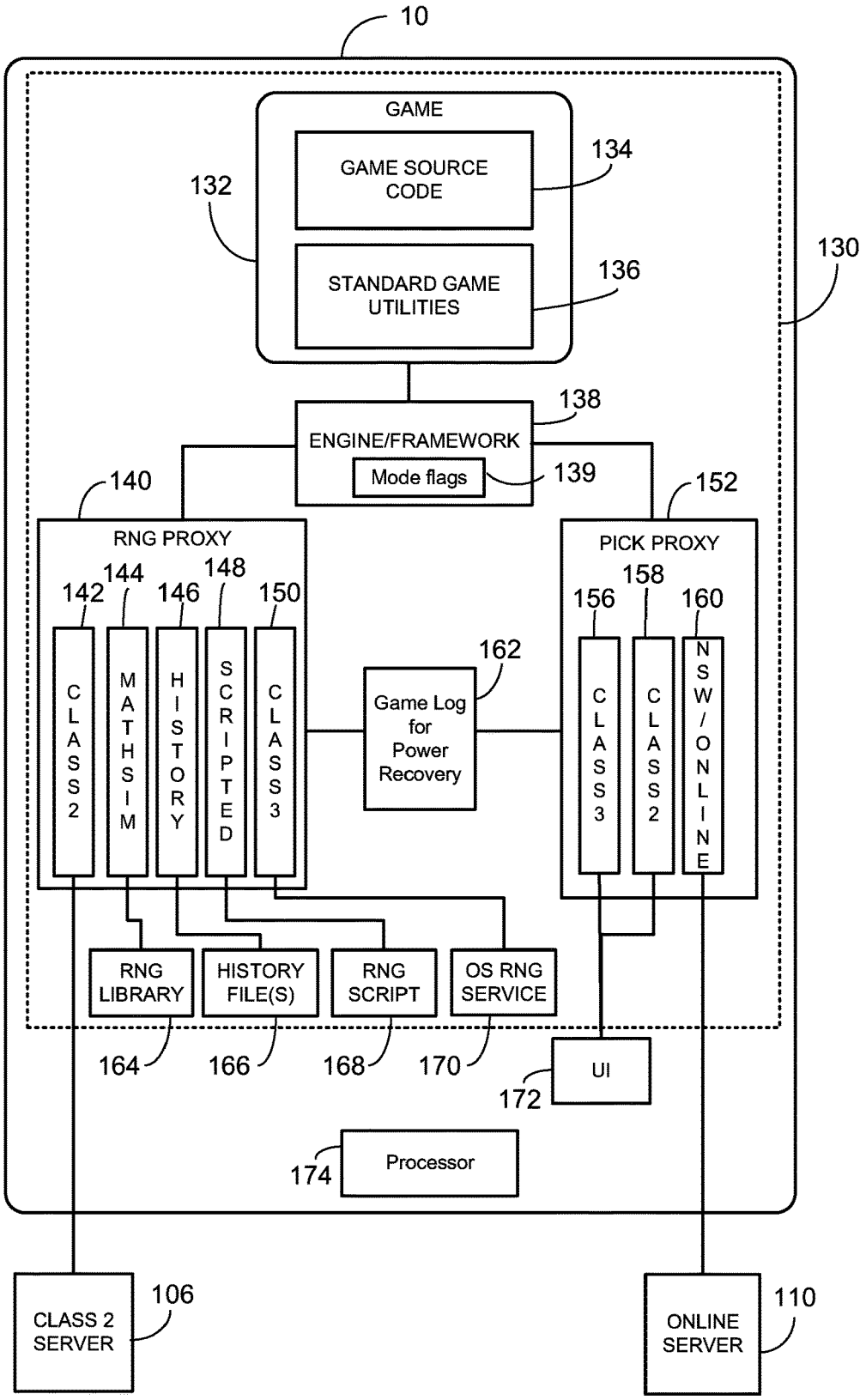
FIG. 2 is a simplified block diagram of a gaming machine.

FIG. 2 is a simplified block diagram of a gaming machine 10 in accordance with the current disclosure. The gaming machine 10 may include a memory 130, a user interface 172, and a processor 174, connected and operating in a conventional manner for a gaming machine. See additional description below with respect to FIG. 4.

The memory 130 may include a game 132 that may itself be broken into game source code 134 and game utilities 136. The game source code may be those elements that are distinctive to the game, such as game strategy, graphics, other look and feel elements, etc. The game utilities 136 may include features for memory and operating system interface. Game source code 134 and game utilities 136 may be compiled into one or more executable objects. An engine/framework 138 may expose various standard functions, such as payment processing but also including calls to the random number proxy 140 and the pick proxy 152, also called the user selection proxy. The framework 138 may also include one or more mode flags 139 to indicate a current operating mode.

By way of describing the operation of the gaming machine 10, various of these operating modes are discussed and described.

Power recovery—As each game is played, the user selections and random numbers used to calculate outcomes, such as reel positions, etc., are stored. If the game fails, for example, due to a power outage, steps are taken for recovering the game to its last known state. In an embodiment, the game 132 may begin operating based on an indication from the framework 138 that a game is active. The game 132 may then simply make a request for a user selection. The pick proxy 152 may look for the presence of a game log file 162. If present, the first stored selection may be returned to the game 132. Correspondingly, successive calls for random numbers and additional user selections may be made by the game 132 until no more unread values are left in the game log file 162. Because the interactions may continue at computer speed without the activation of the user interface 172, the recovered game may be available in a matter of seconds. When the pick proxy 152 and the random number proxy 140 have worked through the stored values, the game will continue in a normal player-interaction fashion.

Class 3—Class 3 is one normal player interaction mode. The gaming machine 10 operates independently and uses its local resources to supply responses to the game. For example, if the game 132 calls for a user pick, the pick proxy 152 may use the Class3 module 156 to enable the appropriate user interface 172 to allow the user to make a selection. The user's selection is passed back through the pick proxy 152 to the game 132.

Similarly, if the game 132 calls for a random number, the random number proxy 140 may use a Class3 module 150 to access the operating system's random number generator (RNG) 170, or other RNG function. The random number is then supplied back through the random number proxy 140 to the game 132.

Class 2—Class 2 operation is similar to Class 3 operation as to user selections, with the pick proxy 152 using a Class2 module to access the gaming machine's UI 172. In some embodiments, there may only be one interface to the UI 172, that is, the Class 3 and Class 2 modules 156 and 158 may be combined into one.

However, in Class 2 mode, the random number generation is different from Class 3. When the game 132 makes a call for a random number, the random number proxy 140 may determine that the game mode is Class 2 and use the Class 2 module 142 to send a message to a remote server 106 to retrieve a file of random numbers from remote server 106 set. As calls for random numbers are made by the game 132, the random number proxy 140 will return values from the file. It is also possible to support live interaction between the Class 2 module 142 and the remote server 106, for example, when network availability is very high.

History—Most jurisdictions require an ability to replay a set number of previously played games, such as ten. This can be used to validate a payout by confirming that the machine was not tampered with during play. For example, at the completion of a game, the game log file 162 can be transferred to a history file location 166. When a particular game is to be replayed, the history mode is set and a particular game file may be selected. The game 132 operates normally and all requests for random numbers and user selection are directed to the history file 166 via the framework 138 and the random number proxy 140. In another embodiment, the history file 166 may be accessed via the pick proxy 152. As in each other operating mode, the game 132 is unmodified and operates without knowledge of the ultimate source of user selection and random numbers.

NSW/Online—NSW or online operation may be used or required in some jurisdiction and specifies that all results come from a central service. (NSW stands for New South Wales, Australia, a jurisdiction that requires this mode.) When operating in this mode, the pick proxy 152 directs all input requests to an online server 110. In this mode, outcomes are returned from the online server 110 so that no random numbers are separately generated or accessed via the random number proxy 140. More specifically, all the outcomes for a game are pre-generated using a random number generator and stored in a list. The next outcome in the list will be presented without respect to the input, e.g., button, selected by the user at the gaming machine 10. In contrast, a class 3 game lays out values per pick item, e.g., button.

Even though FIG. 2 illustrates the gaming machine 10 connected to multiple servers 106 and 110, but because the operating environments are typically dictated by local regulations, only one of servers would be connected at one time, if any are used at all.

Pay table test—In this mode, specific outcomes can be set to see that a payout for a particular outcome is accurate. Originally, this mode was used to set the mechanical reels of a gaming machine, for example, to cherry/cherry/cherry. Several jurisdictions, such as Arizona and Singapore, now also require this capability for electronic gaming machines. When set to this mode, a simulation module 144 may use a predetermined library 164 to return values for setting outcomes.

Scripted—Similar to pay table test mode, this mode directs requests for random numbers to a scripted module 148 that returns values using a random number script 168. The script may provide preselected values to test different scenarios in a game. During such scripted operation, results may be captured and used for validation or for fault analysis.

Figure 3:
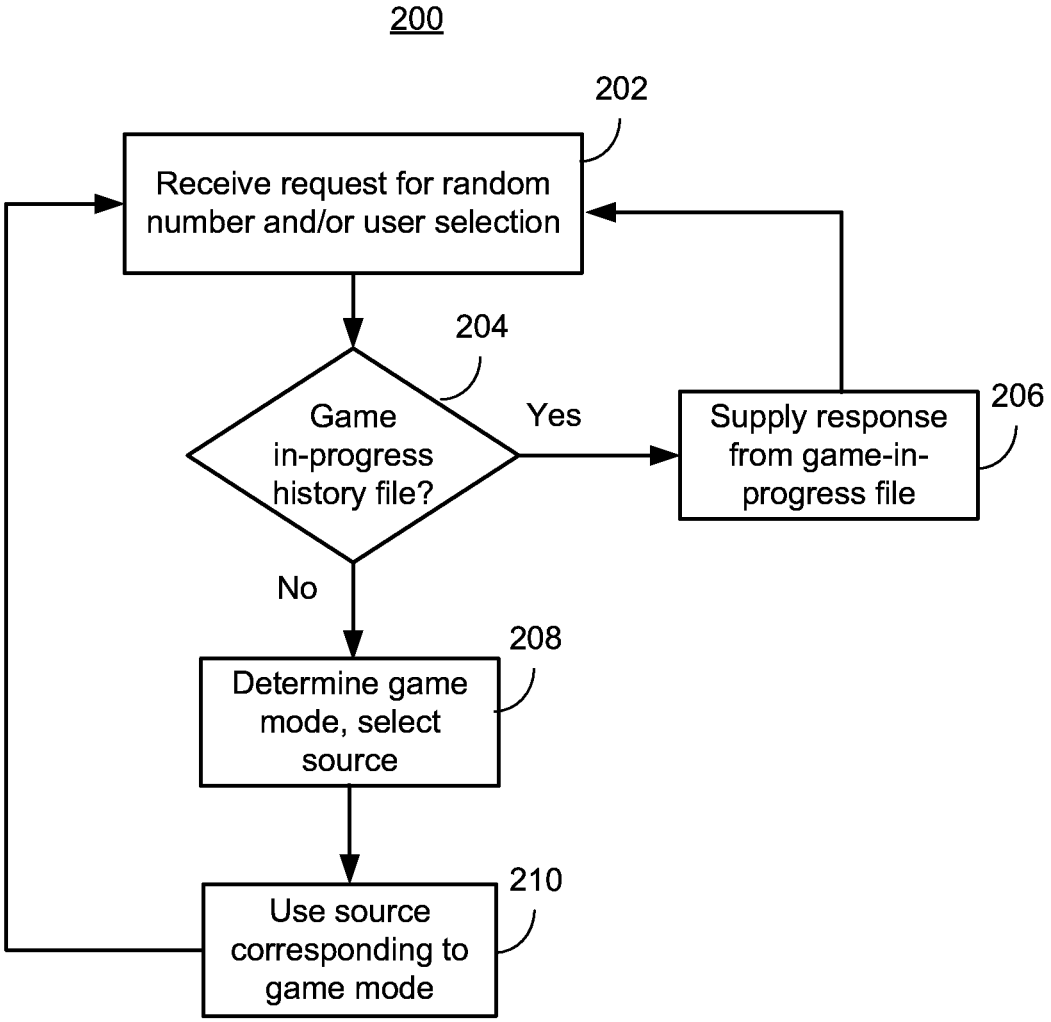
FIG. 3 is a flowchart of a method of operating a gaming machine.

FIG. 3 is a flowchart of a method 200 of operating a gaming machine 10 and more particularly a framework 138 and associated proxies 140 and 152 for managing game modes. While this method 200 represents one embodiment of operating the gaming machine, other variations are possible that are generally in keeping with the disclosure.

At block 202, a request for a value may be received from a game 132. A framework 138 may route the requests to a random number proxy 140 or a pick proxy 152 according to the nature of the request.

At block 204, a determination may be made as to whether there is a game log 162 for a game-in-progress. If so, the next unused value from the game log may be used for the relevant pick, that is, a random number returned via the random number proxy 140 or a user selection returned via the pick proxy 152. There are numerous ways to accomplish this. For example, after an unexpected power loss, the operating system or other start up application may identify that the current boot is the result of an unexpected shut down. Through the use of a semaphore or other setting, the framework 138, or the proxies 140, 152 themselves, may determine that a power recovery mode is active. As requests arrive at the proxies 140 and/or 152, values may successively be read from the game log 162 at block 206 and execution returned to block 202 until the game is returned to the last known state before the interruption. At that point, normal operation may be resumed by following the 'no' branch from block 204.

When not in power recovery mode and execution continues at block 208, a game mode may be determined. The game mode may be set by default or may be set via an explicit command from an operator or an external source and may include 'history,' 'pay table test,' or a particular class of operation as described above.'

As discussed above, the various modes determine from which source a proxy will return values. At block 210, the selected source may be used to return either the random number or user selection, as described above.

Other game and operating modes may be used based on jurisdiction, operator preferences, market demands, etc. The techniques described above may be applied to those additional game and operating modes in a similar fashion. Similarly, the game mode block 208 may be expanded to select each of the game modes without the second selection step of block 214. Similarly, the integration of the random number proxy 140 and the pick proxy 152 may be more or less integral with the framework 138 based on, among other things, design choice.

Figure 4:
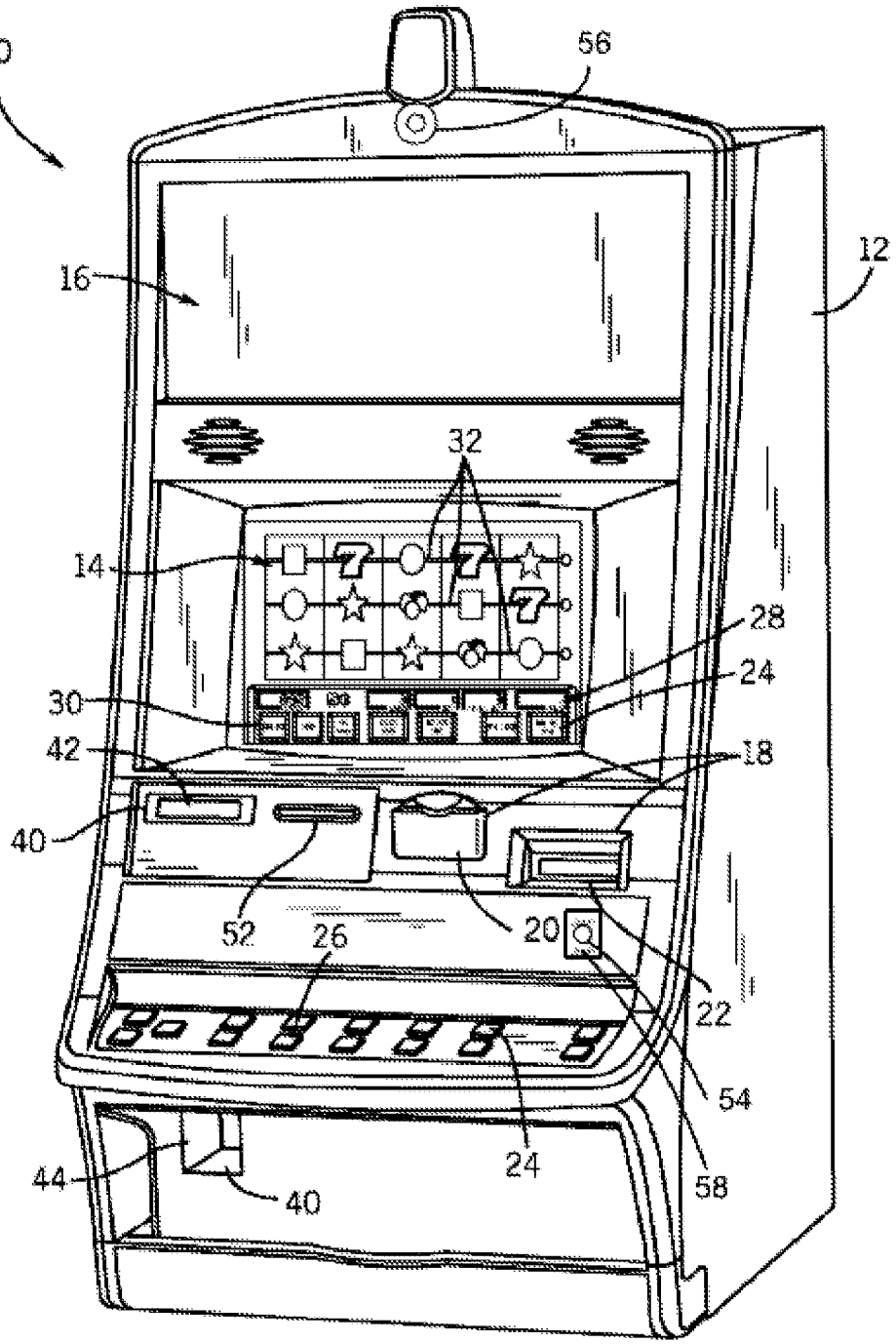
FIG. 4 is a perspective view of a gaming machine.

Referring to FIG. 4, a gaming machine 10 is illustrated that may be used in gaming establishments such as casinos and is suitable for use with the game proxies described above. The gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as slots, keno, poker, blackjack, roulette, etc.

The gaming machine 10 may include a housing 12 and may include input devices, including a value input device 18 and a player input device 24. For output, the gaming machine 10 may include a primary display 14 for displaying information about the basic wagering game. The primary display 14 may also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 may receive currency and/or credits that may be inserted by a player. The value input device 18 may include a coin acceptor 20 for receiving coin currency. Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 may include a plurality of push buttons 26 on a button panel for operating the gaming machine 10. In addition, or alternatively, the player input device 24 may include a touch screen 28 mounted by adhesive, tape, or the like over the primary display 14 and/or secondary display 16. The touch screen 28 may include soft touch keys 30 denoted by graphics on the underlying primary display 14 and may be used to operate the gaming machine 10. The touch screen 28 may provide players with an alternative method of input. A player may enable a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of operating the game, while the touch keys 30 may allow for input needed for another aspect of the game. In some embodiments, a physical player sensor 56 may also be included. The physical player sensor 56 may be a camera or a biometric sensor or a motion detecting device. The physical player sensor 56 may be used to provide inputs to the game, such as images, selection motions, biometric data and other physical information.

The various components of the gaming machine 10 may be connected directly to, or contained within, the housing 12, as seen in FIG. 4, or may be located outboard of the housing 12 and connected to the housing 12 via a variety of different wired or wireless connection methods. Thus, the gaming machine 10 may include these components whether housed in the housing 12, or outboard of the housing 12 and connected remotely.

The operation of the basic wagering game may be displayed to the player on the primary display 14. The primary display 14 may also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 may include the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 may be slanted at about a thirty-degree angle toward the player of the gaming machine 10.

A player may begin play of the basic wagering game by making a wager via the value input device 18 of the gaming machine 10. A player may select play by using the player input device 24, via the buttons 26 or the touch screen keys 30. The basic game may include of a plurality of symbols arranged in an array, and may include at least one payline 32 that indicates one or more outcomes of the basic game. Such outcomes may be randomly selected in response to the wagering input by the player. At least one of the plurality of randomly-selected outcomes may be a start-bonus outcome, which may include any variations of symbols or symbol combinations triggering a bonus game.

In some embodiments, the gaming machine 10 may also include a player information reader 52 that allows for identification of a player by reading a card 54 with player information 58 indicating his or her true identity. The player information reader 52 is shown in FIG. 4 as a card reader, but may take on many forms including a ticket reader, bar code scanner, RFID transceiver or computer readable storage medium interface. Currently, identification 58 may be generally used by casinos for rewarding certain players with complimentary services or special offers. For example, a player may be enrolled in the gaming establishment's loyalty club and may be awarded certain complimentary services as that player collects points in his or her player-tracking account. The player may insert his or her card 54 into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to recall or restore game assets that the player achieved and saved during a previous game session either in the gaming establishment or on a separate computing device at a different location.

Each of these embodiments and obvious variations thereof is contemplated as falling within the spirit and scope of the present disclosure as defined and set forth in the following claims. Moreover, the present concepts expressly include any and all combinations and subcombinations of the preceding elements and aspects.

What is claimed:

1. A computer-implemented gaming system adapted for isolating game code from its operating environment, the gaming system comprising:
- a processor device that executes code;
- a user interface, coupled to the processor device, for supporting game play; and
- a nontransitory computer-readable memory that stores executable code modules and data, the memory including:
  - a game code module that is executed on the processor device, the game code module implementing a game;
  - a random number proxy module executed on the processor device that:
    - receives a request from the game code module for a random number;
    - evaluates a game play setting;
    - based on the game play setting, chooses a source of random numbers from a plurality of random number sources; and
    - provides the random number responsive to the request for the random number using the chosen one of the plurality of random number sources; and
  - a pick proxy module executed on the processor device that:
    - receives a request from the game code module for a user selection;
    - evaluates the game play setting;
    - based on the game play setting, chooses a source of user selection from a plurality of user selection sources; and
    - returns the user selection to the game code module using the chosen one of the plurality of user selection sources.

2. The computer-implemented gaming system of claim 1, wherein the plurality of random number sources comprises a current game file having at least one previously generated random number.

3. The computer-implemented gaming system of claim 2, wherein the game play setting is power recovery; and
- the random number proxy module returns random numbers from the current game file.

4. The computer-implemented gaming system of claim 1, wherein the plurality of random number sources comprises a random number history file of all random numbers used in a concluded game.

5. The computer-implemented gaming system of claim 4, wherein the game play setting is history mode and the random number proxy module returns random numbers from the random number history file.

6. The computer-implemented gaming system of claim 1, wherein the plurality of random number sources comprises an external source of random numbers used by the random number proxy module to provide random numbers from an external source when the game play setting is Class 2.

7. The computer-implemented gaming system of claim 1, wherein the plurality of random number sources comprises an internal source of random numbers used by the random number proxy module to provide random numbers from an internal source when the game play setting is Class 3.

8. The computer-implemented gaming system of claim 1, wherein the plurality of user selection sources includes a user selection file of user selections made in a current game.

9. The computer-implemented gaming system of claim 8, wherein the pick proxy module returns user selections made in the current game from the user selection file.

10. The computer-implemented gaming system of claim 1, wherein the plurality of user selection sources includes a history file of all user selections made in a concluded game.

11. The computer-implemented gaming system of claim 1, wherein the plurality of sources of random numbers includes an external source of random numbers and an internal source of random numbers.

12. A computer-implemented method in a gaming system having game-logic circuitry including one or more central processing units and one or more nontransitory memory media, the method comprising:

receiving, by the game-logic circuitry, a request for a random number from a game executing on the one or more central processing units, the request absent a requested source of the random number;

evaluating, by the game-logic circuitry, a game play setting;

selecting, by the game-logic circuitry, a source of random numbers from a plurality of sources of random numbers based on the game play setting;

providing, by the game-logic circuitry, a response to the request for a random number to the game, the response including a random number from the selected source of random numbers, the response absent an identification of the source of the random number; and generating, on at least one of one or more display devices, a visible outcome using the random number.

13. The method of claim 12, further comprising:

receiving, via at least one of one or more input devices, a request for a user selection from the game;

selecting, by the game-logic circuitry, a source of user selections from a plurality of sources of user selections based on the game play setting;

providing, by the game-logic circuitry, a response to the request for a user selection to the game, the response including a user selection from the selected source of user selections absent an identification of the source of the user selection.

14. The method of claim 13, wherein selecting the source of user selections from the plurality of sources of user selections comprises selecting from one of a user interface local to the gaming system, a current game file, and a game history file.

15. The method of claim 12, wherein selecting the source of random numbers from the plurality of sources of random numbers comprises selecting from one of a random number generator local to the gaming system, a server remote from the gaming system, a current game file, and a game history file.

16. The method of claim 15, wherein selecting the source of random numbers comprises determining that data from an incomplete current game is present and selecting random numbers from the data associated with the incomplete game.

17. The method of claim 12, wherein the game play setting is one of a history mode, a pay table mode, a Class 3 mode, or a Class 2 mode.

18. A computer-implemented method in a gaming system having game-logic circuitry including one or more central processing units and one or more nontransitory memory media, the method comprising:

determining, by the game-logic circuitry, a condition of a current game executing on the gaming system;

intercepting, by the game-logic circuitry, a call for data from the current game executing on the gaming system;

based on the condition of the current game, selecting, by the game-logic circuitry, one of a first source providing real-time data or a second source of data stored in a file on the gaming system associated with a prior game play;

retrieving, by the game-logic circuitry, data from the selected source; and returning, by the game-logic circuitry, the data responsive to the call for use in continuing the current game that is executing on the gaming system.

19. The method of claim 18, wherein intercepting the call from the current game comprises intercepting the call for a random number at a random number module executed on the game-logic circuitry and the first source is a random number generator and the second source of data is a one of a history file or a pay-table test file.

20. The method of claim 18, wherein intercepting the call from the current game comprises intercepting the call for a user selection at a user selection module executed on the game-logic circuitry and the first source is a user interface of the gaming system and the second source of data is a history file.

* * * * *